US007758049B2

(12) United States Patent
Johnston

(10) Patent No.: US 7,758,049 B2
(45) Date of Patent: Jul. 20, 2010

(54) ROULETTE WITH HI/LOW BETTING AREA

(75) Inventor: David William Johnston, Lenton (GB)

(73) Assignee: Bell Fruit Group Limited, Nottingham (GB)

( * ) Notice: Subject to any disclaimer, the term of this patent is extended or adjusted under 35 U.S.C. 154(b) by 0 days.

(21) Appl. No.: 11/420,651

(22) Filed: May 26, 2006

(65) Prior Publication Data

US 2006/0267281 A1 Nov. 30, 2006

(30) Foreign Application Priority Data

May 26, 2005 (GB) ..... 0510728.9

(51) Int. Cl.
*A63F 5/00* (2006.01)

(52) U.S. Cl. ..... 273/274; 463/21; 273/142 E

(58) Field of Classification Search ..... 273/274, 273/142 R, 142 E–142 G; 463/21, 17
See application file for complete search history.

(56) References Cited

U.S. PATENT DOCUMENTS 5,042,810 A 8/1991 Williams
5,106,091 A 4/1992 Comito et al.
5,779,547 A * 7/1998 SoRelle et al. ..... 463/28
5,857,909 A 1/1999 Rubin et al.
6,059,659 A * 5/2000 Busch et al. ..... 463/17
6,506,115 B1 * 1/2003 Mothwurf ..... 463/17
2001/0015529 A1 * 8/2001 Allen ..... 273/292
2002/0135129 A1 * 9/2002 Tarantino ..... 273/292
2003/0104852 A1 * 6/2003 Duhamel ..... 463/13
2004/0164492 A1 * 8/2004 Crenshaw et al. ..... 273/292
2004/0204213 A1 10/2004 Schugar et al.
2005/0032565 A1 * 2/2005 Cheng et al. ..... 463/16
2005/0192079 A1 * 9/2005 Lowery ..... 463/17
2006/0009274 A1 * 1/2006 Finocchio ..... 463/17
2007/0010307 A1 * 1/2007 Falciglia, Sr. ..... 463/13
2007/0060831 A1 * 3/2007 Le et al. ..... 600/544
2007/0126182 A1 * 6/2007 Hoyt et al. ..... 273/292
2007/0129144 A1 * 6/2007 Katz et al. ..... 463/30

* cited by examiner

*Primary Examiner*—William M Pierce
(74) *Attorney, Agent, or Firm*—Michael A. Glenn; Glenn Patent Group

(57) ABSTRACT

An amusement apparatus comprising a roulette wheel (102), a hi/lo betting area (112), wherein, in use, the roulette wheel (102) is arranged to be spun and a winning number generated thereby, the hi/lo betting area (112) being arranged to allow a player to place a bet on whether the winning number generated by a spin of the roulette wheel (102) will be higher or lower than the winning number of a preceding spin.

17 Claims, 2 Drawing Sheets

ROULETTE WITH HI/LOW BETTING AREA

The present invention relates to amusement apparatus.

A standard European roulette wheel consists of thirty-seven slots numbered from zero to thirty-six. In total, thirty-seven numbers are represented on the betting layout; eighteen red, eighteen black and one green zero (there are two zeros on the American version of the game). Each game begins when the wheel is spun in one direction and a ball is spun along an inner edge of the wheel in the opposite direction. As the wheel turns, the ball loses momentum. It bounces among the slots and finally falls into one of the numbered slots. That number is the declared winner for that game.

The single-zero European roulette wheel has a house edge (i.e. the casino's profit) of 2.70%. The player has a 1 in 37 chance of winning on odds of 35 to 1. This is relatively favourable to the player when compared to other gambling games, fruit machines, etc.

The above described standard roulette game can be found in casinos and also portrayed in a video gaming format using CRT monitors, LCD or plasma screens.

Innovations in gambling games are always sought as new games may draw new players and may maintain the interest of existing players. Further, games with odds which favour casinos, machine operators and the like are always appreciated by gaming industry.

According to a first aspect of the present invention, there is provided amusement apparatus comprising a roulette wheel and a hi/lo betting area, wherein, in use, the roulette wheel may be spun and a winning number generated thereby, the hi/lo betting area providing the opportunity to place a bet on whether the winning number generated by a spin of the roulette wheel will be higher or lower than the winning number of a preceding spin.

This is advantageous as it may result in greater interest from a player.

The odds offered for a bet on a higher or lower winning number preferably depend on the winning number of the preceding spin. The odds may therefore vary between spins, which may be attractive to a player.

In some embodiments, the apparatus further comprises an odds display area, which is arranged to display data relating the return on a higher and/or lower bet to a player. As the odds for the 'hi-lo' gamble (i.e. be on the higher or lower winning number) change from spin to spin, it is advantageous to have some way of portraying these.

In some embodiments the apparatus may further comprise an odds generator arranged to generate odds that are offered for a bet. The odd display area may be arranged to display the odd generated by the odds generator.

The odds display area may comprise a variable display, such as a video display screen, an LCD screen, an array of LEDs, a slide mechanism or the like, or a static display such as a chart.

A variable display may be particularly advantageous as it could be controlled to show on the relevant odds for a particular spin, whereas a static display preferably shows the odds for all possible spins.

The amusement apparatus may further comprise a winning number betting area, providing the opportunity to place a bet on the winning number of a spin. The winning number betting area may comprise a traditional roulette betting layout. This may allow the game to maintain its traditional look and keep the interest of players who wish to play the game in the traditional manner. Further, providing two options for the type of bet that can be placed may increase the attraction of the game.

A memory means may be provided and arranged to record the winning number generated by the roulette wheel. Conveniently, the memory means is an electronic memory. However, the memory means may be any form of machine readable medium.

The machine may be arranged to compare the winning number with a stored number in the memory means.

Generally, the stored number was generated in the previous spin of the roulette wheel preceding the generation of the winning number. However, this need not be the case the stored number against which the winning number is compared could have been generated in any number of earlier spins. For example, the stored number may have been generated by the roulette wheel in 2, 3, 4, 5, 6, 7, 8, 9 or more spins preceding the current spin (i.e. the spin that generated the winning number).

The machine may be arranged to determine, in the comparison, whether the winning number is higher, lower or the same as the stored number. The machine may be arranged to determine that a player has won if the bet that has been placed is determined to be correct.

The machine may further comprise a payout means arranged to award a prize when the machine determines that a player has won.

According to a second aspect of the present invention, there is provided an entertainment machine comprising a display means, the display means arranged to display a roulette wheel, wherein, in use, the roulette wheel may be spun and a winning number generated thereby, the machine further comprising an input means arranged to allow a user of the machine to place a bet on whether the winning number of a spin of the roulette wheel will be higher or lower than the winning number of a preceding spin.

The odds offered for a bet on higher or lower winning number preferably depend on the winning number of the preceding spin.

The entertainment machine may be computer, for example a home computer or a laptop computer, provided with software and/or hardware to provide the game. Alternatively or additionally, the entertainment machine may be a telephone, a television, a Personal Digital Assistant (PDA) or any suitable processing device.

The entertainment machine may comprise an odds display area arranged to display data relating the return on a higher and/or lower bet to a player. The odds display area may be displayed on the display means of the entertainment machine or may be displayed on one or more further display means.

The entertainment machine may further comprise a winning number betting area, providing the opportunity to place a bet on the winning number of a spin. The winning number betting area may comprise a representation of a traditional roulette betting layout. The winning number betting area may be displayed on the display means of the entertainment machine or may be displayed on one or more further display means.

Elements described in relation to the first aspect of the invention may apply, mutatis mutandis, to the second aspect of the invention and visa versa.

The display means may comprise any one or more of the following: a Cathode Ray Tube (CRT) display; a Liquid Crystal Display (LCD); an ElectroLuminescent (EL) display; a Light Emitting Polymer (LEP) display; an Electrophoretic displays; Light Emitting Diodes (LEDs) including High Brightness LEDs (HBLEDs), Organic LEDs (OLEDs); or any suitable display.

According to a third aspect of the present invention, there is provided a network of at least two entertainment machines according to the second aspect of the invention.

The machines may be located in the same vicinity, for example in an amusement arcade. This may be advantageous as players could play the game in a social atmosphere. Alternatively, the machines could be linked remotely, for example by the Internet.

Two or more machines could have a common display means. This may be advantageous in that, for example, the odds associated with a gamble could be centrally displayed, which may attract players. Further, a game being played could be displayed on a central screen so that on-lookers could readily watch, as in a traditional roulette game.

According to a fourth aspect of the invention there is provided a computer program arranged to cause a primary display means to generate a representation of a roulette wheel, which can spun in order to generate a winning number, the computer program being further arranged to allow an input to be made such that a user may place a bet on whether the winning number of a spin of the representation of the roulette wheel will be higher or lower than the winning number of a preceding spin.

According to a fifth aspect of the invention there is provided a machine readable medium containing instructions which when read onto a machine cause that machine to perform as the machine of any of the above aspects of the invention.

The machine readable medium of any of the aspects of the invention may be any one or more of the following: a floppy disk; a CDROM/RAM; a DVD ROM/RAM (including +R/+RW, −R/−RW); any form of magneto optical disk; a hard drive; a memory; a transmitted signal (including an internet download, file transfer, or the like); a wire; or any other form of medium.

Embodiments of the invention are now described by way of example only with reference to the accompanying Figures, of which:

Figure 1:
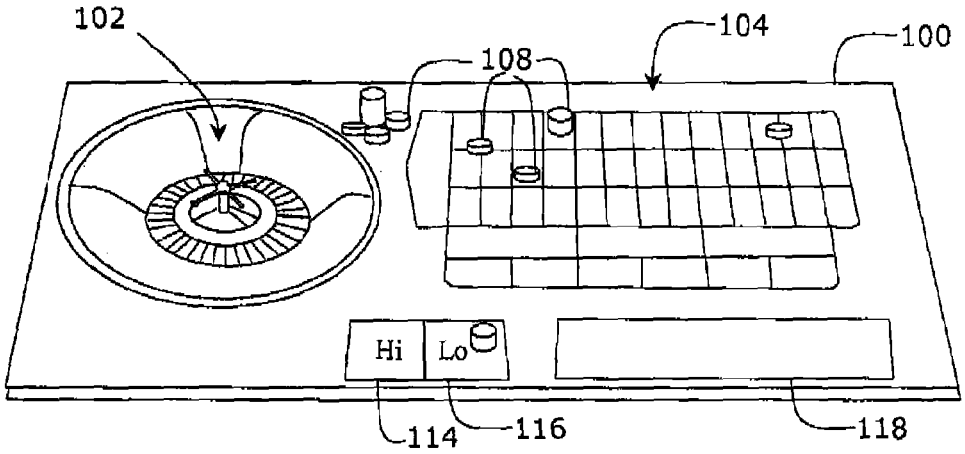
FIG. 1 shows a perspective view of a roulette table incorporating a Hi-Lo game according to one embodiment of the present invention.
Figure 2:
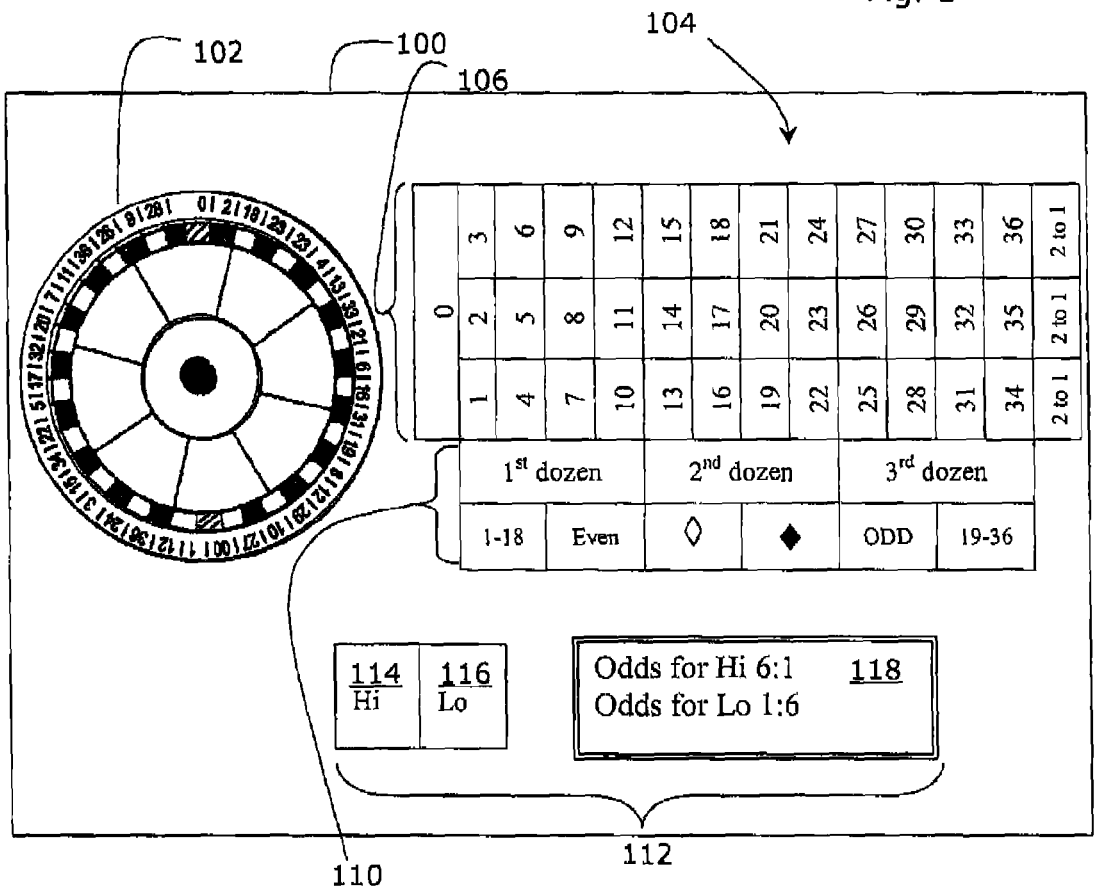
FIG. 2 shows a plan view of the table of FIG. 1.

The amusement apparatus shown in FIGS. 1 and 2 comprises a roulette table 100 in which is inset a roulette wheel 102 arranged as is standard in the art and a betting layout 104. On the roulette wheel 102, the numbers are not consecutively arranged around the wheel. By design, they alternate between red and black and all red numbers are opposite black numbers (in the Figures, red is represented with white).

The betting layout 104 provides a winning number betting area and comprises a number zero, an inside betting area 106, showing the numbers one through thirty six and an outside betting area 110. As will be familiar to the man skilled in the art, so called 'inside bets' consist of the following:

Single-number bets, including the zero and one through thirty-six, which are made by placing a chip 108 in the center of a number selection. If that number is the slot in which the roulette ball finishes then the win is 35-to-1 for every chip 108 bet—the return on one chip 108 therefore being thirty-six chips 108 including the original bet;

Six number bets, which are made by placing a chip 108 at the top of and in-between connecting columns of three numbers, which pay 5-to-1;

Four number bets, which are made by placing a chip 108 on the corner of any four connecting numbers, which pay 8-to-1;

Three number bets, which are made by placing a chip 108 on any connecting group of three numbers which pay 11-to-1; and Two number bets, which are made by placing a chip 108 between two connecting numbers, which pay 17-to-1.

The outside betting area 110, comprises areas in which to make the following bets: odd or even bets (which pay even money), red or black (also pays even money), a bet on one to eighteen, or nineteen to thirty-six, (pays even money). Odds of 2-to-1 are given for selecting the winning number within the first, second or third dozen numbers or for selecting any of the numbers in the three vertical columns of twelve numbers, located at an end region of the betting layout.

All the bets described above have odds that do not vary from spin to spin.

The roulette table 100 further comprises a hi/lo betting area 112. The hi/lo betting area 112 comprises a Hi zone 114, in which chips 108 may be placed if a player believes that the next spin of the wheel will result in a winning number higher than the immediately preceding spin, and a Lo zone 116, in which chips 108 may be placed if a player believes that the next spin of the wheel will result in a winning number lower than the immediately preceding spin.

The hi/lo betting area 112 further comprises an odds display area, in this case a Liquid Crystal Display (LCD) screen 118 embedded in the table.

The odds that are offered for the 'hi' and 'lo' bets (i.e. the choices in the Hi-lo gamble) that are displayed on the screen 118 are dependent on the previous winning number. For example if the previous number was thirty, the odds offered for gambling lower, i.e. the winnings offered following a player placing a chip 108 in the Lo zone 116 (where the likely outcome is a win) will be lower than in the case where the previous number was a ten.

In this embodiment, the odds of gambling higher and lower are calculated on the basis that the betting on both outcomes simultaneously would produce odds of '1-to-1' or even money. However, the presence of the zeros and the possibility of the same winning number coming up twice in a row result in a loss to all players and this gives the game its 'house edge', or in other words allows the casino, or other owner, to make a profit.

Figure 3:
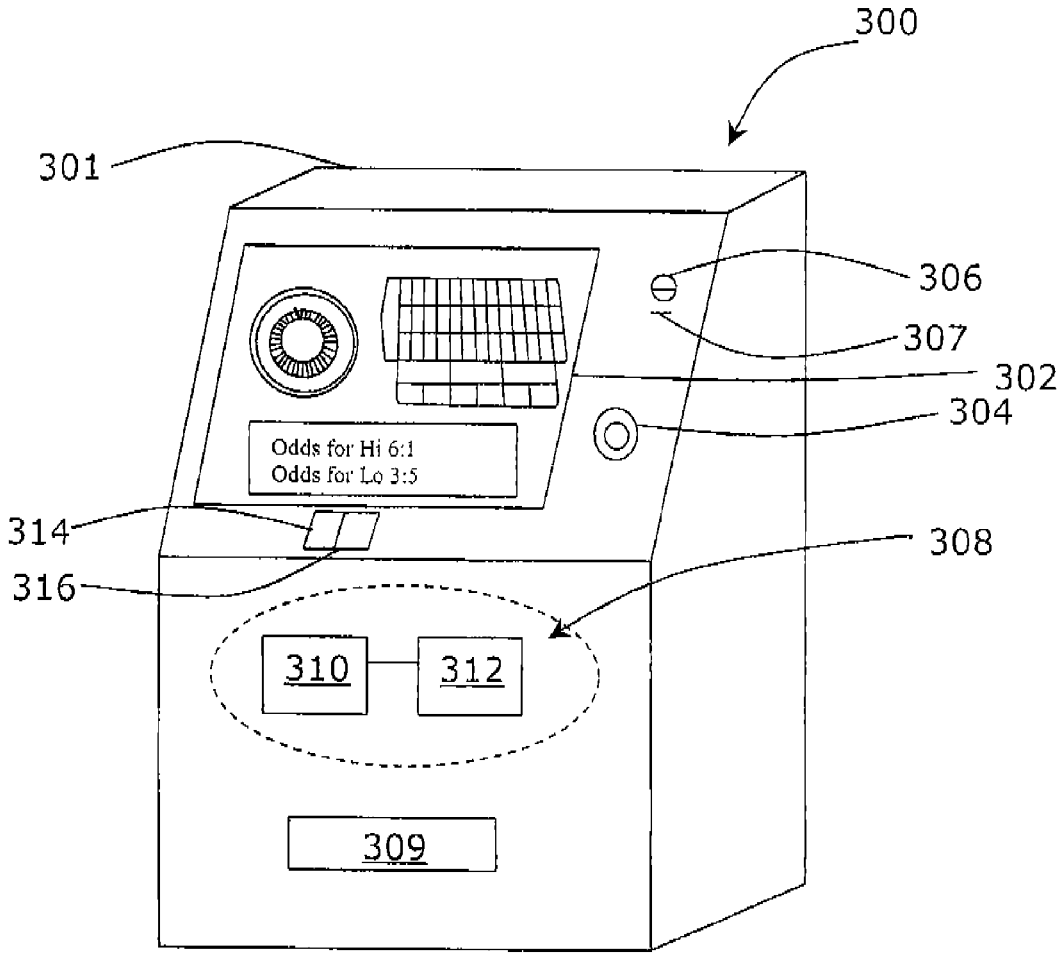
FIG. 3 shows an entertainment machine arranged to provide a roulette game according to one embodiment of the present invention.

FIG. 3 shows an entertainment machine 300 comprising a cabinet 301 in which is housed a primary display means which is a screen 302, in this case a Cathode Ray Tube (CRT) screen arranged to display a roulette game. The machine also comprises at a convenient user operable height an input means 304 and a coin slot 306. The input means 304 is arranged to allow a player to move a cursor over the screen and further to make selections based on the area of the screen over which the cursor is positioned. The machine 300 further comprises a coin-retrieval slot 307 from which a player may collect his/her coins should the machine reject them and a payout slot 309 from which a player can collect his/her winnings. The machine further comprises a Hi gamble button 314 and a Lo gamble button 316. The Hi gamble button 314 and the lo gamble button 316 may also be thought of as input means in some embodiments of the invention.

The payout slot 309 has a payout mechanism associated therewith which together provide what may be thought of as a payout means. The payout means may be arranged to return coins, bank notes, tokens or the like to a player of the machine. In other embodiments the payout means may be arranged to return credit to an account of the player, to provide a non monetary prize (such as a watch, toy, or the like), print a voucher, cause a prize to be delivered to as address specified by the player. The person skilled in the art will appreciate that there are many mechanisms to provide a prize to a player and it is envisaged that the payout means may be any one of these.

Such machines are commonly referred to in the art as video machines, although the invention may be applicable to machines that are not, or are not completely video machines, such as a machine incorporating a physical wheel.

Inside the cabinet 301 there is processing circuitry 308 comprising of a controller 310 and an associated memory 312. The memory 312 may be thought of as a memory means which may be any form of machine readable medium. The processing circuitry 308 is arranged to provide the game and to control the screen 302 in order to display the game to the player. The processing circuitry 308 is capable of receiving inputs from any of the input means 304, the Hi gamble button 314 and the lo gamble button 316, allowing, during use of the machine 300, a player to control the game being played on the machine of FIG. 3. The processing circuitry may also provide an odds generator which is utilised to generate odds for display on an odds display area. The display area may be provided on the screen or as an area on the apparatus of FIG. 1.

The input means 304 may be any suitable form of input device and includes a joystick, a trackball, a touch sensitive pad, buttons (perhaps as described in British patent application GB 0417843.0), a touch sensitive element on the display 302, or the like.

Generally the processing circuitry will include a processor which will commonly be a device such as an Intel™ Pentium™ series, an AMD™ Athlon™, a PowerPC™, etc. The processor will generally be arranged to access instructions stored in the memory 312 and also to store data in the memory 312 as the person skilled in the art will fully appreciate.

It will be appreciated that although the memory 312 is shown as being within the machine 300 this need not be the case and the memory may be remote from the machine 300 but connected thereto via a connection such as a network connection. It should be appreciated that the term memory is envisaged to mean any memory which is accessible by the controller. Indeed, the memory may be so-called virtual memory provided by an apparatus such as a hard drive, which may also be remote from the machine.

In use of the machine 300, play of the game proceeds as follows. A player places coins into the coin slot 306 until sufficient credit has been inserted, at which point the processing circuitry 308 controls the screen 302 in order to display the game to the player. In the illustrated embodiment, the screen 302 is caused to display a representation of a roulette wheel, a winning number betting area and an odds display area. The player may then use the input means 304 to move the cursor around the screen and may thereby place a virtual chip in the betting area. Once the chip is placed, the roulette wheel is 'spun', perhaps by providing a graphical representation of a spinning wheel and a winning number is determined. The number may be determined randomly, but in a preferred embodiment, the number is determined pseudo-randomly in order that the payout of the machine 300 may be kept within desired limits. The winning number is stored within the memory 312.

Before the next spin, processing circuitry 308 generates and causes the screen 302 to display odds in the odds display area. The player has a choice of placing a similar bet and/or making a hi-lo gamble. To make the hi-lo gamble, the player makes an input to the machine using the Hi button 314 or the Lo button 316. The wheel is then spun again to generate a winning number. The machine is then arranged to compare this winning number with the number that has been stored in the memory 312 from the previous spin. The result of this comparison determines whether the player has won a prize (i.e. a player would win if they had gambled that the next number would be higher and this outcome is borne out by the comparison or the player had gambled that the next number would be lower and this outcome is borne out by the comparison). In the event of a win, the player may collect his/her winnings from the payout slot 309.

In the embodiment being described the machine only comprises a primary display. However, in other embodiments the machine may comprise other display means.

In alternative embodiments, which do not depart from the scope of the present invention, the odds display area may comprise a simple printed or written chart. The precise rules of the hi-lo gamble feature may be varied from the above embodiment. For example, two further options are detailed below:

i. The range of numbers included in the hi-lo gamble is one to thirty-six. A zero as a winning number produces a loss. The same number (the winning number is not higher or lower) produces what is known as a 'push', wherein the stake is returned.

ii. The range of numbers included in the hi-lo gamble is zero to thirty-six. A zero as a winning number does not necessary produce a loss—it is dependent on the direction of the bet placed. The same number (the winning number is not higher or lower) produces a loss.

Some embodiments of the invention may provide a network of machines as shown in FIG. 3.

The invention claimed is:

1. A method of offering and resolving a wager using an amusement apparatus and a digital processor comprising:

providing a roulette wheel;

providing a hi/lo betting area, wherein the roulette wheel is configured to be spun and a winning number generated thereby, wherein the hi/lo betting area is configured to allow a player to make at least one wager with a house, said at least one wager being selected from among a group of wagers comprising:

whether the winning number generated by a spin of the roulette wheel will be higher than a winning number of a preceding spin;

whether the winning number generated by the spin of the roulette wheel will be lower than a winning number of a preceding spin; and whether the winning number generated by a spin of the roulette wheel will be equal to the winning number of a preceding spin;

configuring the digital processor with an odds generating module and a displaying module;

generating the odds that are offered for the at least one wager using the odds generating module such that the odds generated thereby are dependent on the winning number of the preceding spin, and wherein said odds generator further generates a house-edged return on a successful wager, wherein said house-edged return favors said house;

displaying data relating to the return on a successful wager to a player using the displaying module, wherein the return on a successful wager comprises the house-edged return.

2. The method according to claim 1 further comprising:

resolving said at least one wager with a payout configured to award a prize when a player has won.

3. The method according to claim 1 further comprising:

displaying odds for the bet in the odds display area, wherein the odds display area comprises a static display, such that a player can look up the odds for the bet.

4. The method according to claim 1 further comprising:

configuring a winning number input area, to provide the opportunity to place a wager on winning number of a spin.

5. An amusement apparatus comprising:

a data processor;

a memory in communication with the data processor;

a roulette wheel in communication with the data processor and configured to be spun to generate a winning number which is communicated to the data processor;

wherein the data processor is configured to:

store said winning number in said memory, forming a stored number; compare the subsequent winning number with the stored number; and determine whether the subsequent winning number is higher, lower or the same as the stored number;

a hi/lo betting area in communication with the data processor and allowing a player to make at least one wager with a house, said at least one type of wager being selected from among a group of wagers comprising whether a subsequent winning number generated by a spin of the roulette wheel will be higher than a winning number of a preceding spin; whether the subsequent winning number generated by the spin will be lower than the winning number of the preceding spin; and whether the winning number generated by the spin will be equal to the winning number of the preceding spin;

a means for communicating at least one wager from a player to the data processor; and an odds generator for calculating the odds that the winning number generated by the spin will be higher or lower than the winning number of the preceding spin, wherein the odds generator includes a means for calculating a house-edged return on the at least one wager, wherein said house-edged return favors said house.

6. An amusement apparatus according to claim 5 further comprising an odds display area configured to display said odds and said house-edged return.

7. An amusement apparatus according to claim 5 further comprising at least one of the following: a video display screen; an LCD screen; an array of LEDs; a slide mechanism or the like.

8. An entertainment machine comprising:

a data processor;

a memory in communication with the data processor;

a primary display in communication with the data processor; and a user interface having at least one input, wherein the at least one input is in communication with the data processor, thus allowing a user to interface with the data processor, and wherein the data processor is configured to accomplish the steps of:

displaying a representation of a roulette wheel on the primary display;

displaying a prior winning number of a roulette spin;

storing the prior winning number in the memory;

generating the odds that the winning number generated by the spin of the roulette wheel will be higher or lower than the winning number of the preceding spin;

receiving an input from the user interface, wherein the input is indicative of a wager placed by a user with a house on whether a winning number of a spin of the roulette wheel will be higher than the prior winning number, lower than the prior winning number, or equal to the prior winning number;

handicapping the return on the at least one wager such that the handicapped return favors said house, in the form of a house-edged return;

displaying the odds that the winning number generated by the spin of the roulette wheel will be higher or lower than the winning number of the preceding spin;

displaying the house-edged return;

simulating a spin of the roulette wheel on the primary display, thereby generating a winning number;

storing the winning number into the memory;

comparing the winning number with the prior winning number to determine whether the wager is won; and displaying whether the wager is won.

9. An entertainment machine according to claim 8 which further comprises a payout arranged to award a prize when the user has won the wager, wherein the payout is consistent with the house-edged return.

10. An entertainment machine according to claim 8 further comprising an odds display area arranged to display the odds generated by an odds generator, wherein the odds display area displayed on one or more further displays in addition to the primary display.

11. An entertainment machine according to claim 8 further comprising a winning number input area, wherein the winning number input area comprises an area arranged to provide the opportunity to place a bet on winning number of a spin.

12. An entertainment machine according to claim 11 wherein the winning number input area is displayed on the primary display of the entertainment machine.

13. An entertainment machine according to claim 11 wherein the winning number input area is displayed on a one or more further displays.

14. An entertainment machine according to claim 8 comprising at least two entertainments machines.

15. An entertainment machine according to claim 14 wherein the at least two entertainment machines are networked via the Internet.

16. An entertainment machine according to claim 14 wherein the at least two entertainment machines have a common display means.

17. A computer readable medium containing instructions to be run on a computer entertainment machine, resulting in images being displayed on a computer display comprising:

a data processor;

a memory in communication with the data processor;

a primary display in communication with the data processor; and an input in communication with the data processor and configured to allow a user to make an input to the data processor, wherein the data processor is configured to accomplish the steps of:

displaying a representation of a roulette wheel;

displaying a prior winning number of a roulette spin;

storing the prior winning number in the memory;

generating the odds that the winning number generated by the spin of the roulette wheel will be higher or lower than the winning number of the preceding spin;

receiving an input from the user interface, wherein the input is indicative of a wager placed by a user with a house on whether a winning number of a spin of the roulette wheel will be higher than the prior winning number, lower than the prior winning number, or equal to the prior winning number;

handicapping the return on the at least one wager such that the handicapped return favors said house, in the form of a house-edge;

displaying the odds that the winning number generated by the spin of the roulette wheel will be higher or lower than the winning number of the preceding spin;

displaying the house-edged return;

causing the representation of the roulette wheel to spin thereby generating a winning number;

store the winning number in the memory of the machine;

comparing the winning number generated by the spin of the roulette wheel with the number stored in the memory and associated with the previous spin;

determining whether the winning number is higher, lower, or the same as the stored number; and determining whether the wager has been won.

* * * * *